US007552764B2

(12) United States Patent
Weems et al.

(10) Patent No.: US 7,552,764 B2
(45) Date of Patent: Jun. 30, 2009

(54) TUBULAR HANDLING DEVICE

(75) Inventors: Craig Weems, Houston, TX (US); Stanislaw Casimir Sulima, Spring, TX (US); Brian Ellis, Spring, TX (US)

(73) Assignee: Nabors Global Holdings, Ltd., Hamilton (BM)

( * ) Notice: Subject to any disclaimer, the term of this patent is extended or adjusted under 35 U.S.C. 154(b) by 49 days.

(21) Appl. No.: 11/619,946

(22) Filed: Jan. 4, 2007

(65) Prior Publication Data

US 2008/0164693 A1 Jul. 10, 2008

(51) Int. Cl.
*E21B 19/00* (2006.01)

(52) U.S. Cl. ..... 166/85.1; 166/98; 166/77.51; 166/75.14; 175/423; 294/94

(58) Field of Classification Search ..... 166/77.1, 166/75.14, 85.1, 380, 98, 77.51; 175/423; 294/93, 94, 68.25, 86.3, 86.31; 464/162, 464/167

See application file for complete search history.

(56) References Cited

U.S. PATENT DOCUMENTS

| | | | | |
|---|---|---|---|---|
| 1,486,471 | A | 3/1924 | Wilcox | |
| 1,829,760 | A | 11/1931 | Santiago | |
| 2,178,999 | A | 11/1939 | Scott | |
| 2,203,118 | A | 6/1940 | Williams | |
| 2,211,016 | A | 8/1940 | Krell | |
| 2,775,304 | A | 12/1956 | Zandmer | |
| 3,522,966 | A | 8/1970 | Wood | |
| 3,540,533 | A | 11/1970 | Morrill | |
| 3,543,847 | A | 12/1970 | Haeber | |
| 3,897,099 | A | 7/1975 | Scodino et al. | |
| 4,042,231 | A | 8/1977 | Kopczynski et al. | |
| 4,114,404 | A * | 9/1978 | Phelps | 464/152 |
| 4,444,252 | A | 4/1984 | Fisher | |

(Continued)

FOREIGN PATENT DOCUMENTS

GB 2155577 * 9/1985

(Continued)

OTHER PUBLICATIONS

Det Norske Veritas, "Technical Report: BSW Limited Design and Engineering: Testing of Ballgrab Anchor Connector," Report No. 2002-3263, Jul. 31, 2002, http://www.ballgrab.co.uk/downloads/dnvfatiguereport.pdf.

*Primary Examiner*—David J Bagnell
*Assistant Examiner*—Sean D Andrish
(74) *Attorney, Agent, or Firm*—Haynes and Boone, LLP

(57) ABSTRACT

A tubular handling apparatus comprising a slotted member having a plurality of elongated slots each extending in a direction, a recessed member slidably coupled to the slotted member and having a plurality of recesses each tapered in the direction from a shallow end to a deep end, and a plurality of rolling members each retained between one of the recesses and one of the slots, wherein each rolling member partially extends through the adjacent slot when located in the shallow end of the recess, and wherein each rolling member retracts within an outer perimeter of the slotted member when located in a deep end of the recess. The apparatus may further comprise a plurality of biasing elements each biasing a corresponding one of the rolling members towards the shallow end of the corresponding recess.

20 Claims, 8 Drawing Sheets

U.S. PATENT DOCUMENTS 4,448,255 A 5/1984 Shaffer et al.
4,643,472 A 2/1987 Schukei et al.
4,647,099 A 3/1987 Berry et al.
4,811,784 A 3/1989 Theiss
4,971,146 A 11/1990 Terrell
5,082,061 A 1/1992 Dollison
5,125,148 A 6/1992 Krasnov
5,330,002 A 7/1994 Saunders
5,340,182 A 8/1994 Busink et al.
5,484,222 A 1/1996 Schulze-Beckinghausen
5,553,667 A 9/1996 Budde et al.
5,749,585 A 5/1998 Lembcke
5,967,477 A 10/1999 Walmsley
6,302,199 B1 10/2001 Hawkins et al.
6,305,649 B1 10/2001 Walmsley et al.
6,352,115 B1 3/2002 Mathieu
6,354,372 B1 3/2002 Carisella et al.
6,443,241 B1 9/2002 Juhasz et al.
6,536,520 B1 3/2003 Snider et al.
6,550,128 B1 4/2003 Lorenz
6,557,641 B2 5/2003 Sipos et al.
6,609,573 B1 8/2003 Day
6,622,796 B1 9/2003 Pietras
6,622,797 B2 9/2003 Sivley, IV
6,637,526 B2 10/2003 Juhasz et al.
6,679,333 B2 1/2004 York et al.
6,688,398 B2 2/2004 Pietras
6,691,776 B2 2/2004 Guillory et al.
6,705,405 B1 3/2004 Pietras
6,719,063 B2 4/2004 Adams et al.
6,742,596 B2 6/2004 Haugen
6,752,569 B2 6/2004 Emmett
6,854,515 B2 2/2005 Matthews et al.
6,857,483 B1 2/2005 Dirks et al.
6,913,096 B1 7/2005 Nielson et al.
6,920,926 B2 7/2005 York et al.
6,938,709 B2 9/2005 Juhasz et al.
6,966,385 B2 11/2005 Hemphill et al.
6,976,298 B1 12/2005 Pietras
6,991,265 B2 1/2006 Walmsley et al.
7,137,454 B2 11/2006 Pietras
7,140,443 B2 11/2006 Beierbach et al.
7,191,840 B2 3/2007 Pietras et al.
2001/0042625 A1 11/2001 Appleton
2002/0000333 A1 1/2002 Cicognani
2002/0070027 A1 6/2002 Ohmer et al.
2002/0074132 A1 6/2002 Juhasz et al.
2002/0107020 A1 8/2002 Lee
2002/0162665 A1 11/2002 Adams et al.
2002/0189817 A1 12/2002 Davidson et al.
2003/0000708 A1 1/2003 Coone
2003/0000742 A1 1/2003 Juhasz et al.
2003/0019636 A1 1/2003 Robichaux
2003/0066654 A1 4/2003 Juhasz et al.
2003/0127222 A1 7/2003 Marcin et al.
2003/0155154 A1 8/2003 Oser
2003/0173073 A1 9/2003 Snider et al.
2003/0183396 A1 10/2003 Adams et al.
2003/0196791 A1 10/2003 Dunn et al.
2003/0221842 A1 12/2003 Hayes et al.
2003/0226660 A1 12/2003 Winslow et al.
2004/0011531 A1 1/2004 Pietras
2004/0035572 A1 2/2004 Cooper
2004/0069500 A1 4/2004 Haugen
2004/0084191 A1 5/2004 Laird
2004/0094957 A1 5/2004 Walmsley et al.
2004/0098155 A1 5/2004 Walser et al.
2004/0149451 A1 8/2004 Pietras
2004/0173357 A1 9/2004 Pietras
2004/0182611 A1 9/2004 Ramey et al.
2004/0216924 A1 11/2004 Pietras et al.
2004/0256110 A1 12/2004 York et al.
2005/0000691 A1 1/2005 Giroux et al.
2005/0000696 A1 1/2005 McDaniel et al.
2005/0061548 A1 3/2005 Hooper et al.
2006/0005962 A1 1/2006 Juhasz et al.
2006/0011353 A1 1/2006 Pietras
2006/0102337 A1 5/2006 Elliott et al.
2006/0249292 A1 11/2006 Guidry
2007/0074876 A1 4/2007 Pietras
2007/0095524 A1 5/2007 Lesko

FOREIGN PATENT DOCUMENTS

WO WO2007/124418 A2 11/2007
WO WO2007/127737 A2 11/2007

* cited by examiner

TUBULAR HANDLING DEVICE

TUBULAR HANDLING DEVICE

TUBULAR HANDLING DEVICE

TUBULAR HANDLING DEVICE

TUBULAR HANDLING DEVICE

TUBULAR HANDLING DEVICE

TUBULAR HANDLING DEVICE

TUBULAR HANDLING DEVICE

TUBULAR HANDLING DEVICE

CROSS-REFERENCE TO RELATED APPLICATIONS

This application is related to U.S. patent application Ser. No. 11/410,733, entitled "TUBULAR RUNNING TOOL," filed Apr. 25, 2006, the disclosure of which is hereby incorporated herein by reference.

BACKGROUND

The drilling of subterranean wells involves assembling tubular strings, such as casing strings and drill strings, each of which comprises a plurality of heavy, elongated tubular segments extending downwardly from a drilling rig into a wellbore. The tubular string consists of a number of threadedly engaged tubular segments.

Conventionally, workers use a labor-intensive method to couple tubular segments to form a tubular string. This method involves the use of workers, typically a "stabber" and a tong operator. The stabber manually aligns the lower end of a tubular segment with the upper end of the existing tubular string, and the tong operator engages the tongs to rotate the segment, threadedly connecting it to the tubular string. While such a method is effective, it is dangerous, cumbersome and inefficient. Additionally, the tongs require multiple workers for proper engagement of the tubular segment and to couple the tubular segment to the tubular string. Thus, such a method is labor-intensive and therefore costly. Furthermore, using tongs can require the use of scaffolding or other like structures, which endangers workers.

Others have proposed a running tool utilizing a conventional top drive assembly for assembling tubular strings. The running tool includes a manipulator, which engages a tubular segment and raises the tubular segment up into a power assist elevator, which relies on applied energy to hold the tubular segment. The elevator couples to the top drive, which rotates the elevator. Thus, the tubular segment contacts a tubular string and the top drive rotates the tubular segment and threadedly engages it with the tubular string.

While such a tool provides benefits over the more conventional systems used to assemble tubular strings, it also suffers from shortcomings. One such shortcoming is that the tubular segment might be scarred by the elevator dies. Another shortcoming is that a conventional manipulator arm cannot remove single joint tubulars and lay them down on the pipe deck without worked involvement.

Other tools have been proposed to cure these shortcomings. However, such tools are often unable to handle tubulars that are dimensionally non-uniform. When the tubulars being lifted or otherwise handled are not dimensionally ideal, such as by having a varying wall thickness or imperfect cylindricity or circularity, the ability of tools to adequately engage the tubulars is decreased.

BRIEF SUMMARY

The present disclosure introduces a tubular handling apparatus, comprising: a slotted member having a plurality of elongated slots each extending in a direction; a recessed member slidably coupled to the slotted member and having a plurality of recesses each tapered in the direction from a shallow end to a deep end; a plurality of rolling members each retained between one of the recesses and one of the slots; and a plurality of biasing elements each biasing a corresponding one of the rolling members towards the shallow end of the corresponding recess; wherein each rolling member partially extends through the adjacent slot when located in the shallow end of the recess; and wherein each rolling member retracts to at least within the adjacent slot when located in a deep end of the recess. Each of the plurality of biasing elements may be configured to urge the corresponding one of the rolling members into contact between an edge of the corresponding slot of the slotted member and the corresponding tapered recess of the recessed member. Each of the plurality of biasing elements may be a compression spring. An inner periphery of the recessed member may encompass an outer periphery of the slotted member. At least a portion of the slotted member may have a substantially cylindrical, annulus-shaped cross-section, and at least a portion of the recessed member may have a substantially annulus-shaped cross-section. The inner periphery of one of the recessed and slotted members may conform to the outer periphery of the other of the recessed and slotted members. The direction may be substantially parallel to a longitudinal axis of at least one of the slotted member and the recessed member. The plurality of rolling members may comprise a plurality of spherical members. The plurality of rolling members may comprise a plurality of cylindrical members. The plurality of rolling members may comprise a plurality of tapered cylindrical members.

The present disclosure also introduces a method of handling a tubular member, comprising: interfacing a lifting apparatus into an end of the tubular member, wherein the lifting apparatus comprises: a slotted member having a plurality of elongated slots each extending in a direction; a recessed member slidably coupled to the slotted member and having a plurality of recesses each tapered in the direction from a shallow end to a deep end; a plurality of rolling members each retained between one of the recesses and one of the slots; and a plurality of biasing elements each biasing a corresponding one of the rolling members towards the shallow end of the corresponding recess; wherein each rolling member partially extends through the adjacent slot when located in the shallow end of the recess; and wherein each rolling member retracts to at least within the adjacent slot when located in a deep end of the recess; allowing the plurality of rolling members to become engaged between a substantially cylindrical surface of the tubular member and the plurality of recesses in the recessed member; and lifting the tubular member via the lifting apparatus. Allowing the plurality of rolling members to become engaged may comprise allowing each of the plurality of biasing elements to urge the corresponding one of the plurality of rolling members towards the shallow end of the corresponding one of the plurality of recesses and into engagement with the surface of the tubular member. An inner periphery of the recessed member may encompass an outer periphery of the slotted member.

The present disclosure also introduces a system, comprising: a tubular handling apparatus, comprising: a slotted member having a plurality of elongated slots each extending in a direction; a recessed member slidably coupled to the slotted member and having a plurality of recesses each tapered in the direction from a shallow end to a deep end; a plurality of rolling members each retained between one of the recesses and one of the slots; and a plurality of biasing elements each biasing a corresponding one of the rolling members towards the shallow end of the corresponding recess; wherein each rolling member partially extends through the adjacent slot when located in the shallow end of the recess; and wherein each rolling member retracts to at least within the adjacent slot when located in a deep end of the recess; and means for lifting the tubular handling apparatus. Each of the plurality of biasing elements may be configured to urge the corresponding one of the rolling members into contact between an edge of the corresponding slot of the slotted member and the corresponding tapered recess of the recessed member. Each of the plurality of biasing elements may be a compression spring. An inner periphery of the recessed member may encompass an outer periphery of the slotted member. The inner periphery of one of the recessed and slotted members may conform to the outer periphery of the other of the recessed and slotted members.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
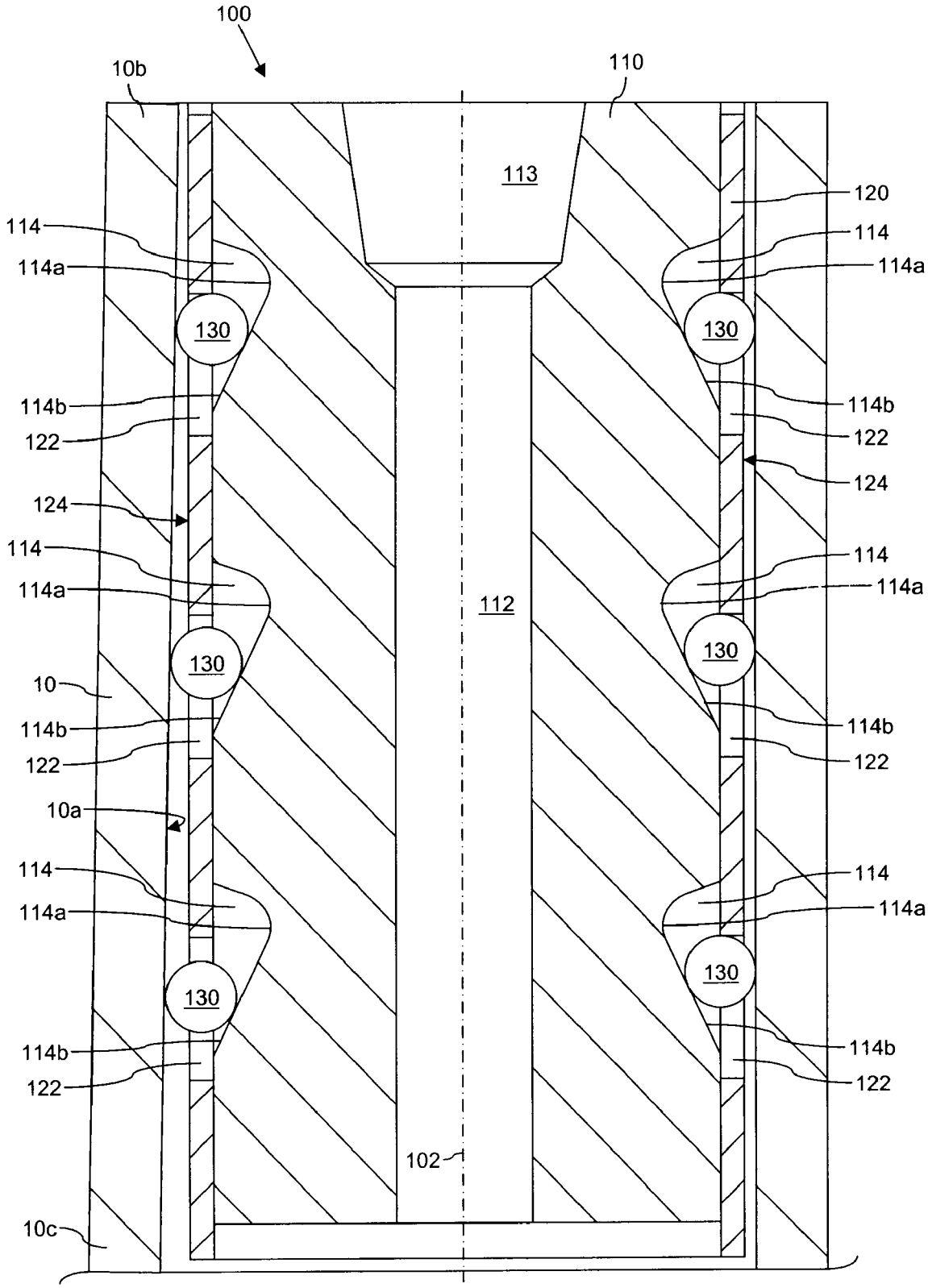
FIG. 1 is a sectional view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the coupling of a first feature to a second feature in the description that follows may include embodiments in which the first and second features are coupled in direct contact, and may also include embodiments in which additional features may be coupled interposing the first and second features, such that the first and second features may not be in direct contact.

Referring to FIG. 1, illustrated is a sectional view of an apparatus 100 for a handling tubular member 10 according to one or more aspects of the present disclosure. The apparatus 100 includes a recessed member 110, a slotted member 120, and a plurality of rolling members 130.

The tubular member 10 may be or comprise a section of collared or threaded pipe, such as may be utilized as a portion of an integral joint casing or drill string. The tubular member 10 may alternatively be or comprise a section of a pipeline, such as may be utilized in the transport of liquid and/or fluid materials. The tubular member 10 may alternatively be or comprise a tubular structural member. The tubular member 10 may have an annulus cross-section having a substantially cylindrical, rectangular or other geometric shape.

The tubular member 10 may not be dimensionally uniform or otherwise ideal. That is, the tubular member 10 may not exhibit ideal roundness or circularity, such that all of the points on an inner surface 10*a* of the tubular member at a certain axial position may not form a perfect circle. Alternatively, or additionally, the tubular member 10 may not exhibit ideal cylindricity, such that all of the points of the surface 10*a* may not be equidistant from a longitudinal axis 102 of the apparatus 100, and/or the tubular member 10 may not exhibit ideal concentricity, such that the axes of all cross sectional elements of the surface 10*a* may not be common to the longitudinal axis 102. For example, in the exemplary embodiment shown in FIG. 1, the diameter of the inner surface 10*a* at an end 10*b* of the tubular member 10 is less than the diameter of the inner surface 10*a* at a central portion 10*c* of the tubular member 10.

The recessed member 110 may be or comprise a substantially cylindrical or otherwise shaped central member having a central passage 112 and a plurality of recesses 114 formed therein. The central passage 112 may be sized to allow fluid, fluid lines and/or electronic cables to pass through the apparatus 100, and may include more than one passage. An end 113 of the passage 112 may include conventional means for forming a threaded or other coupling with another member to which the apparatus 100 is to be attached. For example, the end 113 may comprise the female or "box" end of a pin-and-box threaded connection.

The slotted member 120 may be or comprise a substantially cylindrical or otherwise shaped annulus member having a plurality of slots 122 formed therein. Each slot 122 is configured to cooperate with one of the recesses 114 of the recessed member 110 to retain one of the rolling members 130. Moreover, each recess 114 and slot 122 are configured such that, when the rolling member is moved further away from the maximum depth 114*a* of the recess 114, the rolling member 130 protrudes further through the slot 122 and beyond the outer perimeter 124 of the slotted member 120, and when the rolling member is moved towards the maximum depth 114*a* of the recess 114, the rolling member 130 also moves towards a retracted position within the outer perimeter 124 of the slotted member 120.

For example, each recess 114 may be at least partially defined by a surface 114*b* that is tapered in a direction that is substantially parallel to the longitudinal axis 102 of the apparatus 100. The tapered surface 114*b* may be oriented at an angle of about 7° relative to the outer perimeter or surface 110*a* of the recessed member 110 and/or the inner perimeter or surface 120*a* of the slotted member 120, although other taper values are also within the scope of the present disclosure, such as between about 5° and about 30°. The maximum depth 114*a* of the recess 114 may be at least equal to the difference between the maximum diameter of the rolling member 130 and the wall thickness of the slotted member 120.

Figure 2:
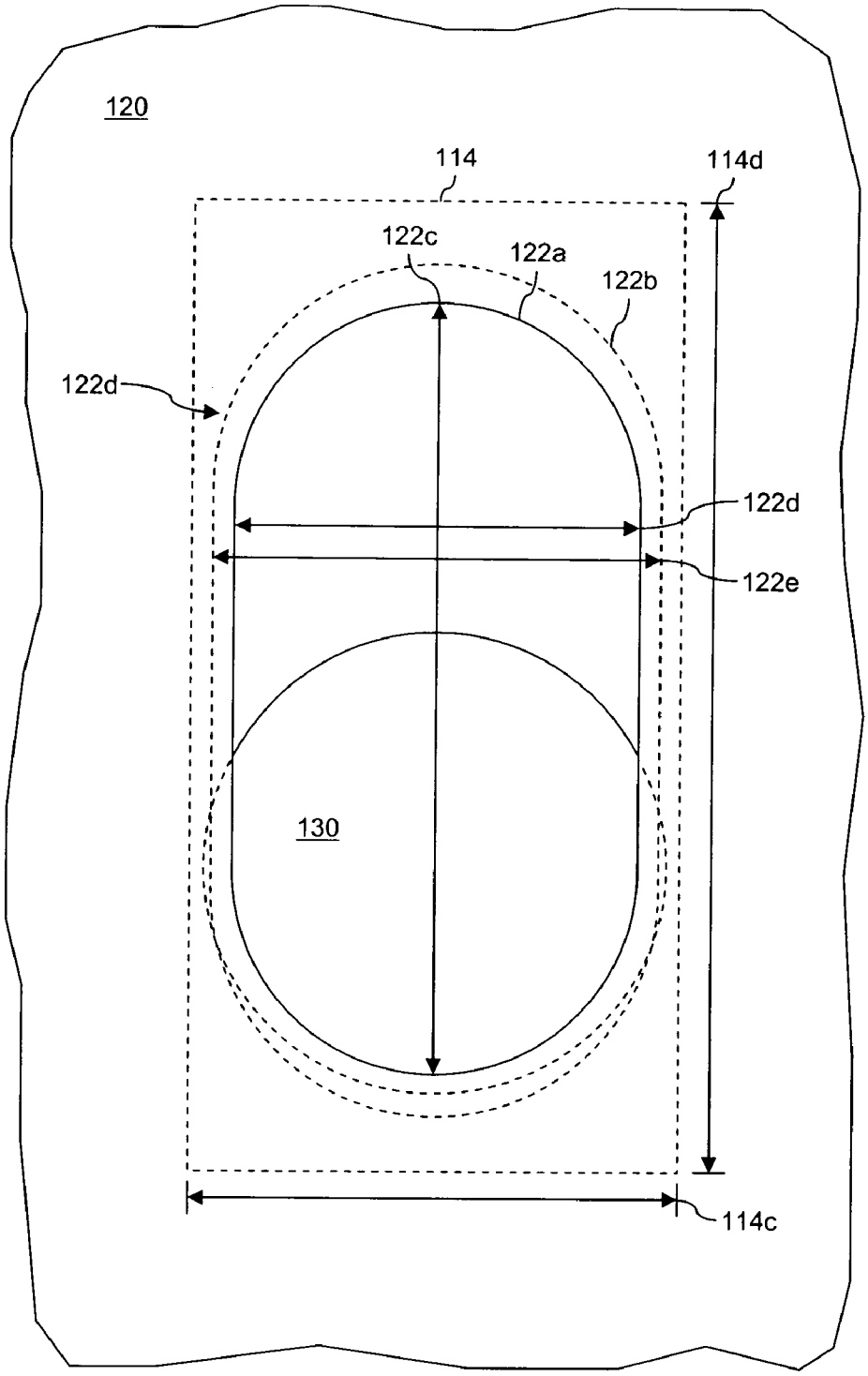
FIG. 2 is a side view of a portion of the apparatus shown in FIG. 1.

FIG. 2 is a side view of a portion of the apparatus 100 shown in FIG. 1, in which several hidden edges are shown as dashed lines. Referring to FIGS. 1 and 2, collectively, each slot 122 may have an oval or otherwise elongated profile, such that each slot 122 is greater in length than in width. In the exemplary embodiment of FIGS. 1 and 2, the length of the slot 122 is in the direction of the longitudinal axis 102 of the apparatus 100. Additionally, the external profile 122*a* of each slot 122 (relative to the slotted member 120) may be encompassed by, inwardly offset, or otherwise smaller than the internal profile 122*b* of each slot 122, such that the walls of the slot 122 may be tapered radially inward.

The recess 114 may have a width 114*c* that is at least about equal to the width or diameter of the rolling member 130 or, as shown in FIG. 2, slightly larger than the width or diameter of the rolling member 130. The recess 114 may also have a length 114*d* that is greater than a minimum length 122*c* of the slot 122. The width or diameter of the rolling member 130 is at least larger than the width 122*d* of the external profile 122*a* of the slot 122 or, as shown in FIG. 2, larger than the width 122*e* of the internal profile 122*b* of the slot 122.

Returning to FIG. 1, because each slot 122 is elongated in the direction of the taper of the recesses 114, each rolling member 130 may protrude from the slotted member 120 an independent amount based on the proximate dimensional characteristics of the tubular member 10. For example, in the exemplary embodiment shown of FIG. 1, because the inner diameter of the tubular member 10 is smaller near the end 10*b* of the tubular member 10, the rolling member 130 located nearest the end 10*b* of the tubular member 10 protrudes from the slotted member 120 a shorter distance relative to the distance which the rolling member 130 nearest the central portion 10*c* of the tubular member 10 protrudes from the slotted member 120.

Figure 3A:
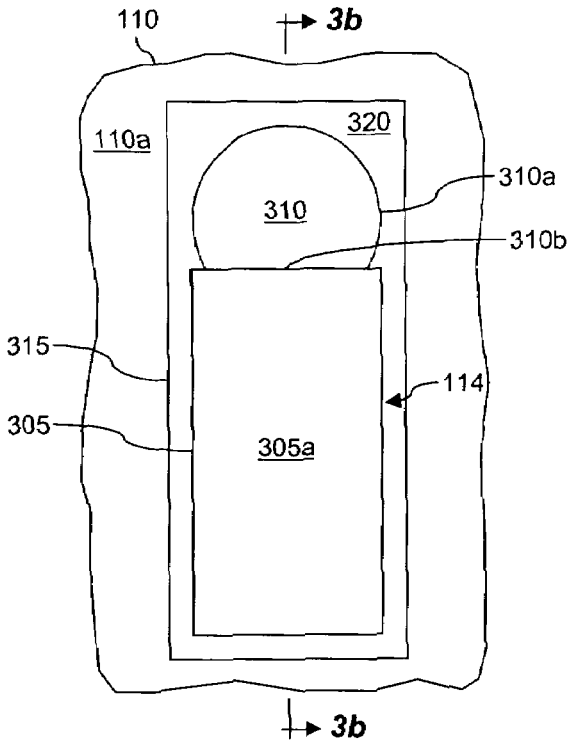
FIG. 3*a* is a side view of a portion of apparatus according to one or more aspects of the present disclosure.
Figure 3B:
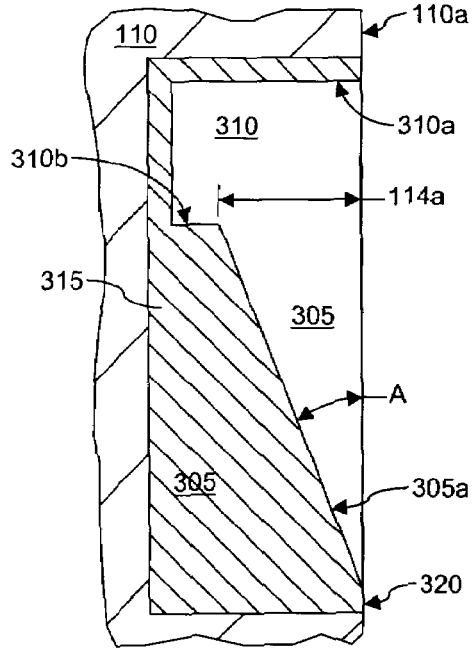
FIG. 3*b* is a sectional view of the apparatus shown in FIG. 3*a*.

FIG. 3*a* is a side view of a portion of the recessed member 110 shown in FIGS. 1 and 2 in an intermediate stage of manufacture according to one or more aspects of the present disclosure. FIG. 3*b* is a sectional view of the portion of the recessed member 110 shown in FIG. 3*a*. The illustrated portion of the recessed member 10 shown in FIGS. 3*a* and 3*b* includes one of the recesses 114 shown in FIGS. 1 and 2.

Referring to FIGS. 3*a* and 3*b*, collectively, and with continued reference to FIGS. 1 and 2, manufacture of the recess 114 may include forming a tapered portion 305 and a biasing insert receiving portion 310. The tapered portion 305 and the biasing insert receiving portion 310 may be formed directly in the recessed member 110, such as by machining, molding, casting and/or other processes. Alternatively, as depicted in FIGS. 3*a* and 3*b*, the tapered portion 305 and the insert receiving portion 310 may be formed in a recess insert 315. The recess insert 315 may comprise one or more metallic, plastic and/or other materials, and may be formed by machining, molding, casting and/or other fabrication processes. The recess insert 315 is configured to be installed into a recess in the recessed member 110 via press fit, interference fit, adhesive, threaded fasteners and/or other means. A surface 320 of the recess insert 315 is configured to be flush with or otherwise substantially conform to the outer perimeter 110*a* of the recessed member 110.

The tapered portion 305 may have a substantially rectangular, oval or otherwise shaped surface 305*a* that is tapered relative to the outer surface 110*a* of the recessed member 110. The taper angle A of the tapered surface 305*a* may range between about 5° and about 30°. For example, in an exemplary embodiment, the taper angle A may be about 7°. However, other taper angles are also within the scope of the present disclosure.

In the exemplary embodiment shown in FIGS. 3*a* and 3*b*, the biasing insert receiving portion 310 has a substantially cylindrical profile 310*a* except for a flat 310*b* adjacent the tapered portion 305. The diameter of the cylindrical profile 310*a* may be substantially similar to the width of the tapered surface 305*a*, although other diameters are also within the scope of the present disclosure. The width of the flat 310*b* may be about 85% of the diameter of the cylindrical profile 310*a*, such as in the illustrated embodiment. However, the ratio of the width of the flat 310*b* relative to the diameter of the cylindrical profile 310*a* may have other values within the scope of the present disclosure, such as between about 50% and about 100%. The depth of the biasing insert receiving portion 310 may also vary within the scope of the present disclosure. For example, the depth of the biasing insert receiving portion 310 may be at least equal to or greater than the maximum depth 114*a* of the tapered portion 305.

Figure 4A:
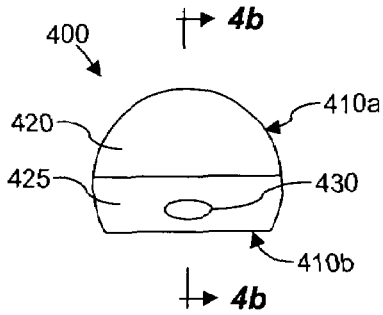
FIG. 4*a* is a side view of a portion of apparatus according to one or more aspects of the present disclosure.
Figure 4B:
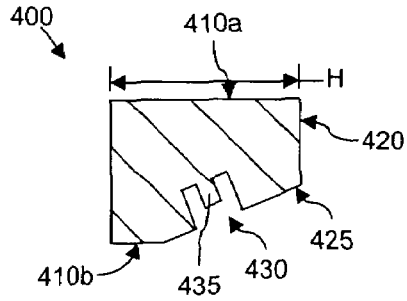
FIG. 4*b* is a sectional view of the apparatus shown in FIG. 4*a*.

FIG. 4*a* is a side view of a biasing insert 400 configured to be installed into the biasing insert receiving portion 310 shown in FIGS. 3*a* and 3*b*. FIG. 4*b* is a sectional view of the biasing insert 400. Referring to FIGS. 4*a* and 4*b*, collectively, and with continued reference to FIGS. 1-3*b*, the biasing insert 400 has a substantially cylindrical profile 410*a* except for a flat 410*b*. The cylindrical profile 410*a* and the flat 410*b* are configured such that the biasing insert 400 can be installed into the biasing insert receiving portion 310 via press fit, interference fit, adhesive, threaded fasteners and/or other means. For example, the diameter of the cylindrical profile 410*a* may be substantially identical to the diameter of the cylindrical profile 310*a*, and the ratio of the width of the flat 410*b* relative to the diameter of the cylindrical profile 410*a* may be substantially identical to the ratio of the width of the flat 310*b* relative to the diameter of the cylindrical profile 310*a*. The height H of the biasing insert 400 may be substantially similar to or slightly less than the depth of the biasing insert receiving portion 310.

A surface 420 of the biasing insert 400 is configured to be flush with or otherwise substantially conform to the outer perimeter 110*a* of the recessed member and/or the surface 320 of the recess insert 315. Another surface 425 is configured to be oriented at 90° or another angle relative to the tapered surface 305*a*. The surface 425 includes a recess 430 configured to receive a compression spring, a spring plunger or another biasing element. The recess 430 may include a protrusion 435 configured to center, retain and/or otherwise engage the biasing element. For example, in an exemplary embodiment in which the biasing element is an open-ended compression spring, the protrusion 435 may have a diameter that is about equal to an internal diameter of the end of the compression spring. The protrusion 435 may extend from the recess 430 beyond the surface 425. However, in other embodiments, such as depicted in FIG. 4*b*, the protrusion may not extend beyond the surface 425.

Figure 5A:
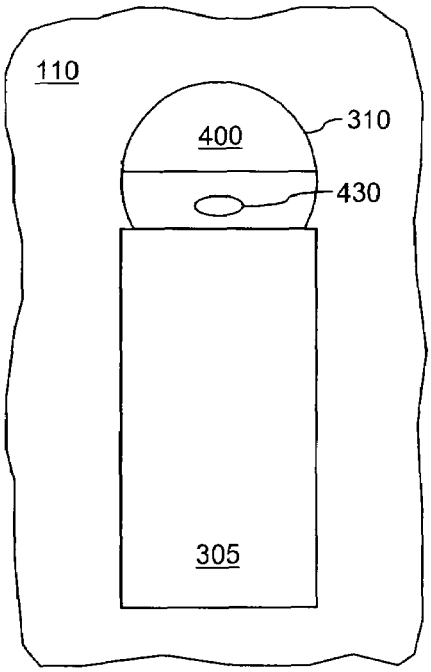
FIG. 5*a* is a side view of a portion of apparatus according to one or more aspects of the present disclosure.

FIG. 5*a* is a side view of the portion of the recessed member 110 shown in FIG. 3*a* after the biasing insert 400 shown in FIG. 4 has been installed into the biasing insert receiving portion 310 shown in FIG. 3*a*. Such installation may be via press fit, interference fit, adhesive, bonding, threaded or mechanical fasteners and/or other means for coupling the biasing insert 400 to the recessed member 110 within the biasing insert receiving portion 310.

Figure 5B:
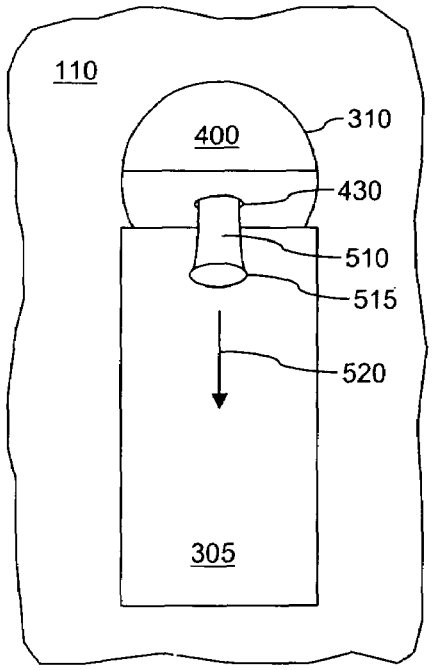
FIG. 5*b* is a side view of the apparatus shown in FIG. 5*a* in a subsequent stage of manufacture.

FIG. 5*b* is a side view of the portion of the recessed member 110 shown in FIG. 5*a* after a biasing element 510 is installed into the recess 430 of the biasing insert 400. The biasing element 510 may be as described above, possibly comprising a compression spring, a spring plunger and/or other means for urging a subsequently installed rolling member in a direction 520. In the exemplary embodiment illustrated in FIG. 5*b*, the biasing element 510 is schematically depicted as a compression spring having a flat, fluted or flared end 515 protruding from the recess 430. Such a flared end 515 of the biasing element 510 may aid alignment and/or seating of the rolling element relative to the biasing element 510 and, thus, the tapered recess portion 305.

Figure 5C:
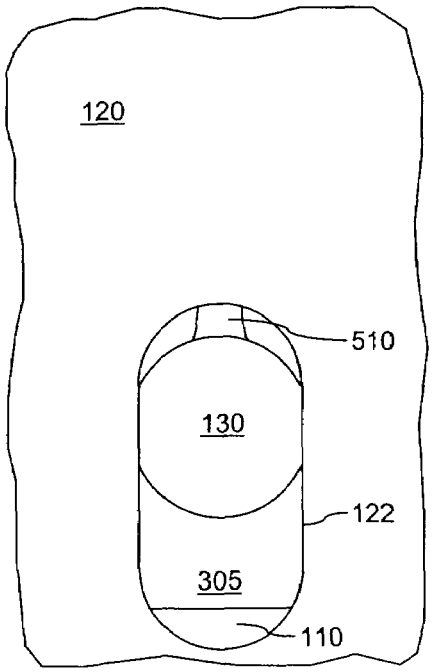
FIG. 5*c* is a side view of the apparatus shown in FIG. 5*b* in a subsequent stage of manufacture.

FIG. 5*c* is a side view of the portion of the recessed member 110 shown in FIG. 5*b* after the rolling element 130 has been positioned in the tapered recess portion 305 and retained therein by the assembly of the recessed member 110 and rolling element 130 within the slotted member 120. Consequently, the biasing element 510 urges the rolling element 130 into contact between the inner perimeter of the slot 122 of the slotted member 120 and the tapered recessed portion 305 of the recessed member 110.

Figure 6:
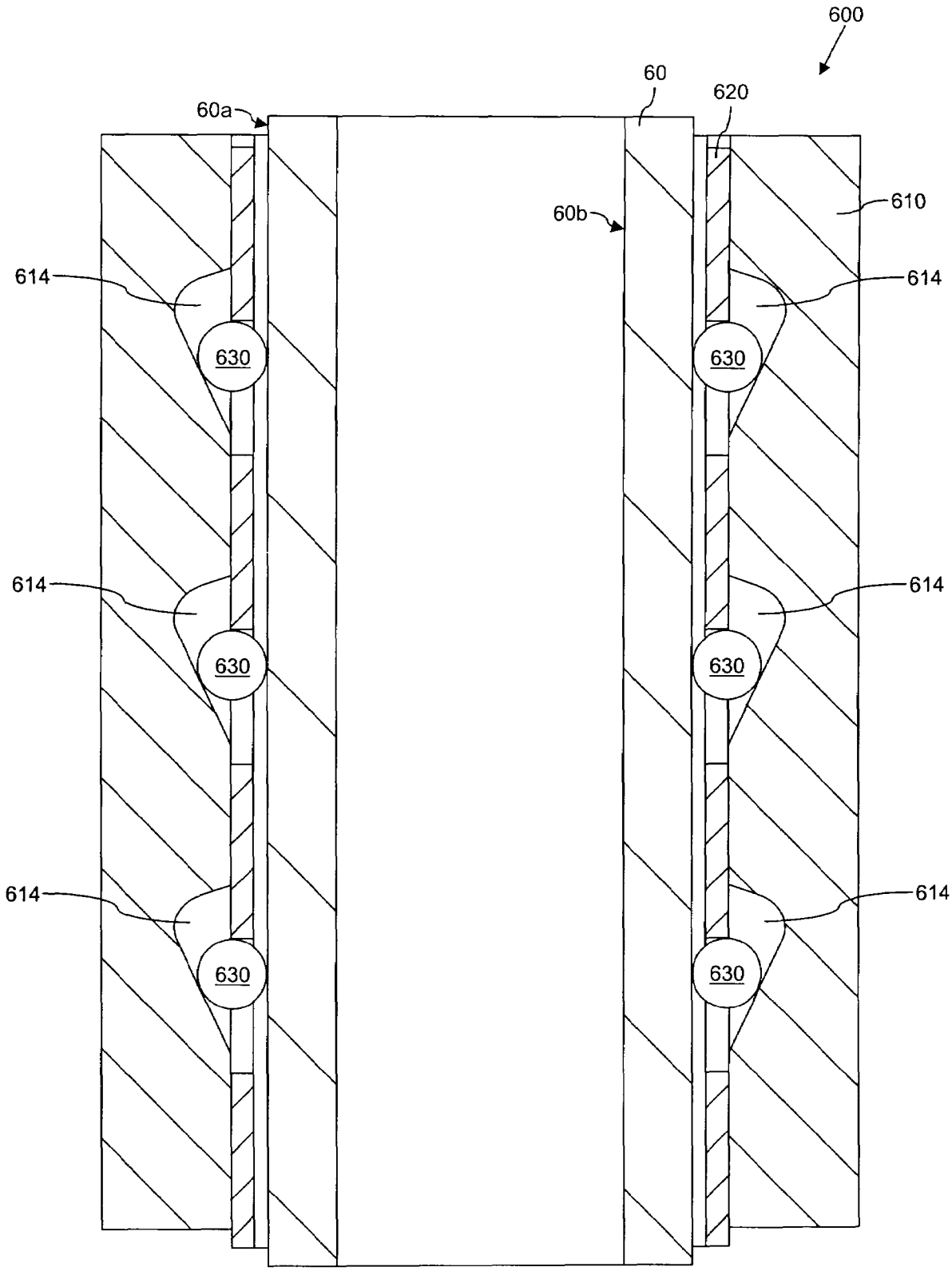
FIG. 6 is a sectional view of apparatus according to one or more aspects of the present disclosure.

Referring to FIG. 6, illustrated is another embodiment of the apparatus 100 shown in FIG. 1, herein designated by the reference numeral 600. The apparatus 600 is configured for a handling tubular member 60 according to one or more aspects of the present disclosure. Moreover, the apparatus 600 is substantially similar to the apparatus 100 shown in FIG. 1. However, where the recessed member 110 of the apparatus 100 is positioned internal to the slotted member 120 and the tubular member 10, the recessed member 610 of the apparatus 600 is positioned external to the slotted member 620 and the tubular member 60. Consequently, when positioned towards the shallow ends of the recesses 614, the rolling members 630 engage the external surface 60*a* of the tubular member 60 instead of the internal surface 60*b* of the tubular member 60.

Figure 7A:
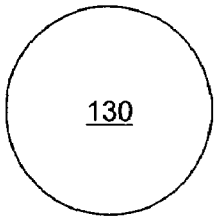
FIGS. 7*a* and 7*b* are orthogonal views of apparatus according to one or more aspects of the present disclosure.
Figure 7B:
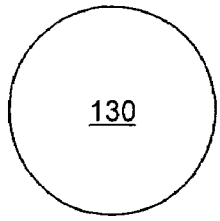
Figure 7C:
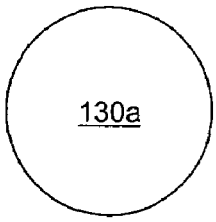
FIGS. 7*c* and 7*d* are orthogonal views of apparatus according to one or more aspects of the present disclosure.
Figure 7D:
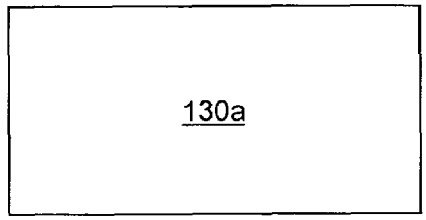
Figure 7E:
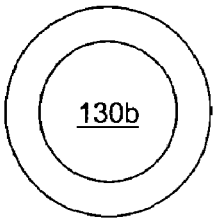
FIGS. 7*e* and 7*f* are orthogonal views of apparatus according to one or more aspects of the present disclosure.
Figure 7F:
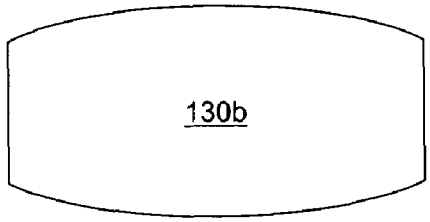

Referring to FIGS. 7*a* and 7*b*, collectively, illustrated are orthogonal views of one embodiment of the above-described rolling member 130 within the scope of the present disclosure. As shown in FIGS. 7*a* and 7*b*, the rolling member 130 may have a substantially spheroid shape. Referring to FIGS. 7*c* and 7*d*, collectively, illustrated are orthogonal views of another embodiment of the rolling member 130, herein designated by reference numeral 130*a*. As shown in FIGS. 7*c* and 7*d*, the rolling member 130*a* may have a substantially cylindrical shape. Referring to FIGS. 7*e* and 7*f*, collectively, illustrated are orthogonal views of another embodiment of the rolling member 130, herein designated by reference numeral 130*b*. As shown in FIGS. 7*e* and 7*f*, the rolling member 130*b* may have a substantially tapered cylindrical shape. Shapes other than those shown in FIGS. 7*a*-7*f* are also within the scope of the present disclosure. Regardless of the shape, the rolling member (130, 130*a* or 130*b*) may have a metallic composition, such as stainless steel.

Figure 8:
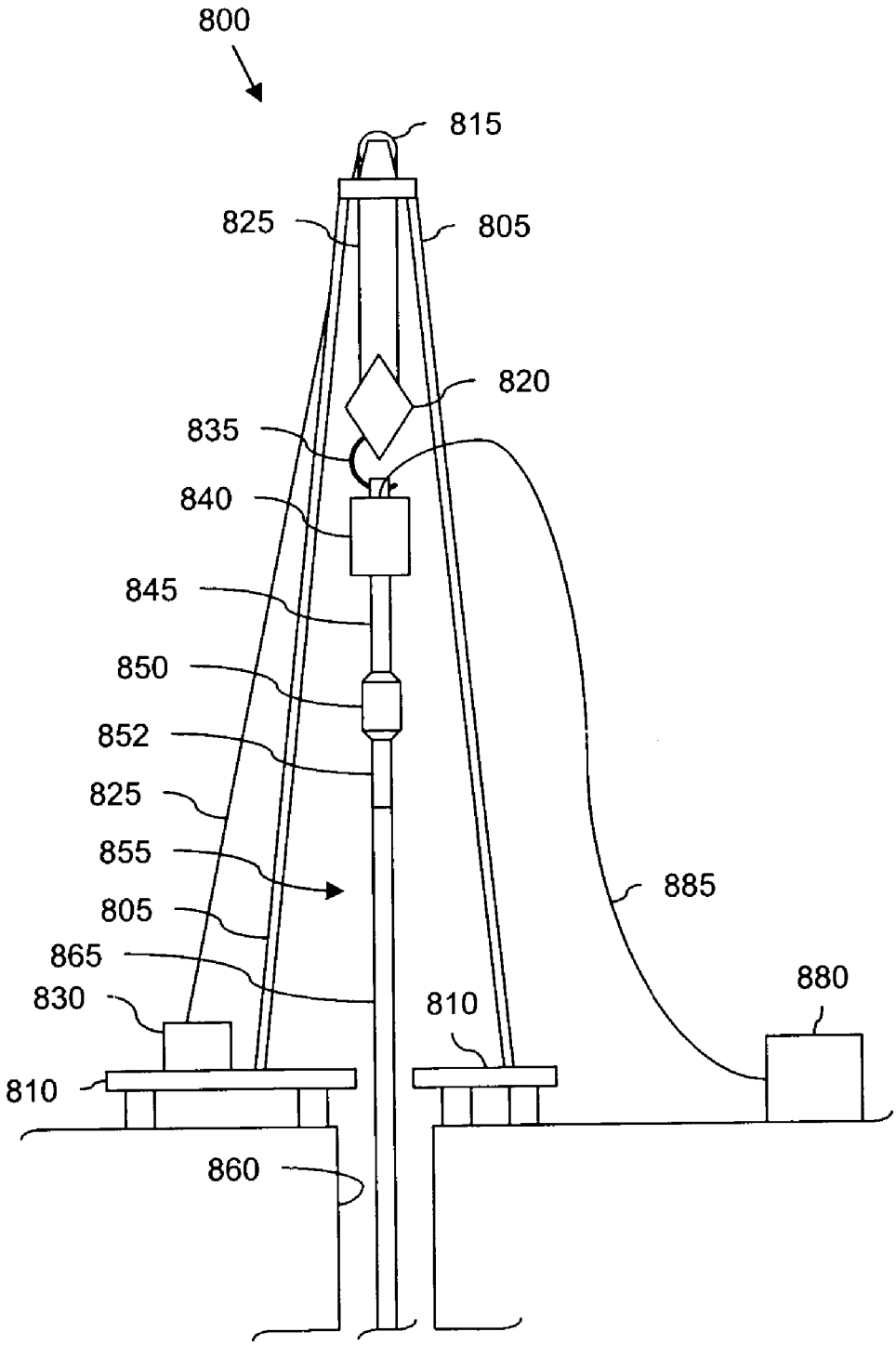
FIG. 8 is a schematic view of apparatus according to one or more aspects of the present disclosure.

Referring to FIG. 8, illustrated is a schematic view of apparatus 800 demonstrating one or more aspects of the present disclosure. The apparatus 800 demonstrates an exemplary environment in which the apparatus 100 shown in FIG. 1, the apparatus 600 shown in FIG. 6, and/or other apparatus within the scope of the present disclosure may be implemented.

The apparatus 800 is or includes a land-based drilling rig. However, one or more aspects of the present disclosure are applicable or readily adaptable to any type of drilling rig, such as jack-up rigs, semisubmersibles, drill ships, coil tubing rigs, and casing drilling rigs, among others.

Apparatus 800 includes a mast 805 supporting lifting gear above a rig floor 810. The lifting gear includes a crown block 815 and a traveling block 820. The crown block 815 is coupled at or near the top of the mast 805, and the traveling block 820 hangs from the crown block 815 by a drilling line 825. The drilling line 825 extends from the lifting gear to draw-works 830, which is configured to reel out and reel in the drilling line 825 to cause the traveling block 820 to be lowered and raised relative to the rig floor 810.

A hook 835 is attached to the bottom of the traveling block 820. A top drive 840 is suspended from the hook 835. A quill 845 extending from the top drive 840 is attached to a saver sub 850, which is attached to a tubular lifting device 852. The tubular lifting device 852 is substantially similar to the apparatus 100 shown in FIG. 1 and/or the apparatus 600 shown in FIG. 6, among others within the scope of the present disclosure.

The tubular lifting device 852 is engaged with a drill string 855 suspended within and/or above a wellbore 860. The drill string 855 may include one or more interconnected sections of drill pipe 865, among other components. One or more pumps 880 may deliver drilling fluid to the drill string 855 through a hose or other conduit 885, which may be connected to the top drive 840. The drilling fluid may pass through a central passage of the tubular lifting device 852, such as the central passage 112 of the apparatus 100 shown in FIG. 1.

In an alternative embodiment, the top drive 840, quill 845 and sub 850 may not be utilized between the hook 825 and the tubular lifting device 852, such as where the tubular lifting device 852 is coupled directly to the hook 825, or where the tubular lifting device 852 is coupled to the hook 825 via other components. For example, the end 113 of the passage 112 of the apparatus 100 shown in FIG. 1 may be threadedly or otherwise coupled to a component interposing the tubular lifting device 852 and the hook 825.

Figure 9:
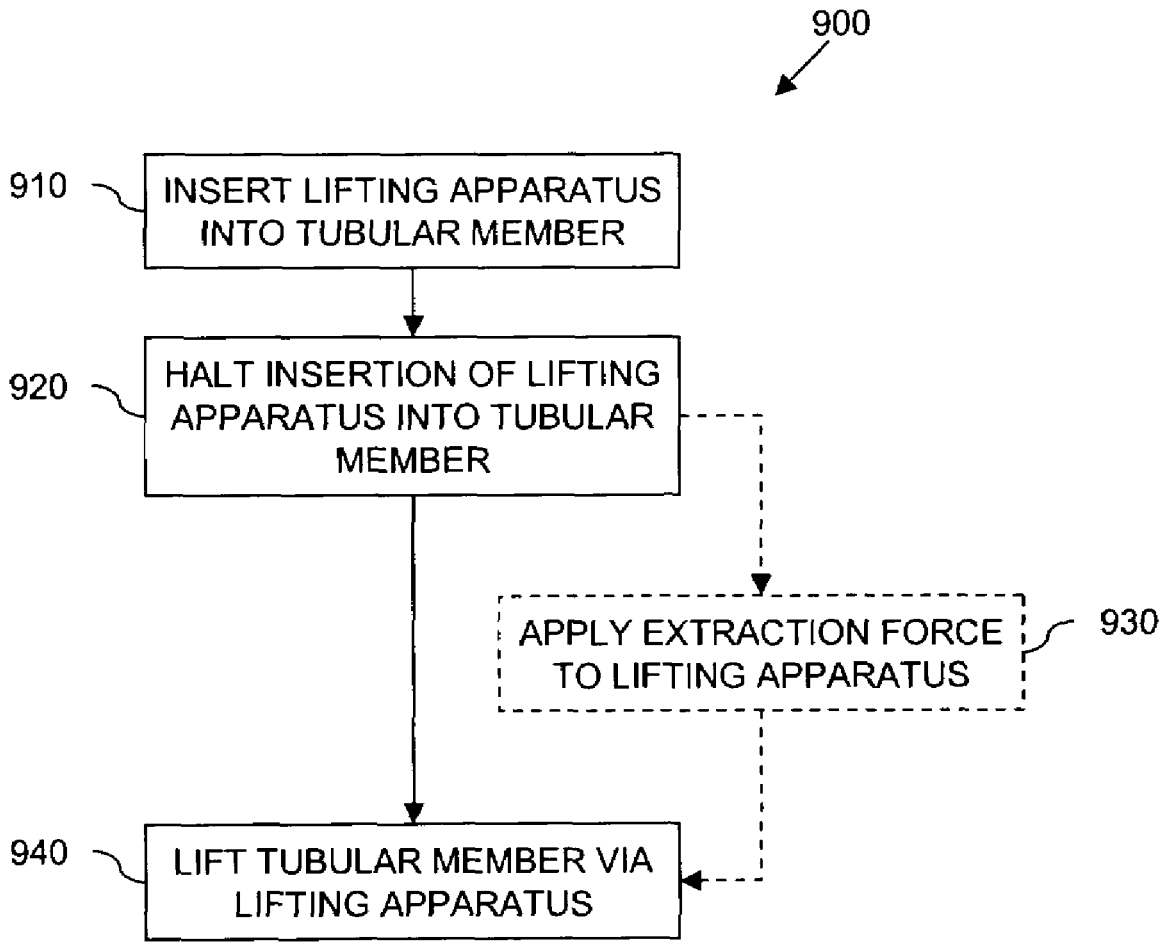
FIG. 9 is a flow-chart diagram of a method according to one or more aspects of the present disclosure.

FIG. 9 is a flow-chart diagram of a method 900 according to one or more aspects of the present disclosure. The method 900 demonstrates an exemplary mode of operation of the apparatus 100 shown in FIG. 1, the apparatus 600 shown in FIG. 6, and other apparatus within the scope of the present disclosure. Accordingly, whereas the following description of the method 900 also refers to features of the apparatus 100 depicted in FIG. 1, aspects of the method 900 are similarly applicable or readily adaptable to features of the apparatus 600 shown in FIG. 6 and/or other apparatus within the scope of the present disclosure.

Referring to FIG. 9, with continued reference to FIG. 1, the method 900 includes a step 910 during which the lifting apparatus 100 is inserted into the tubular member 10. As the apparatus 100 slides into the end of the tubular member 10, frictional forces between the internal surface 10*a* of the tubular member 10 and the external surface 124 of the slotted member 120 will urge the slotted member 120 towards the end 10*b* of the tubular member 10, or upwards in the orientation shown in FIG. 1. Consequently, the rolling members 130 will be urged against the biasing elements or otherwise travel into the deeper portions of the recesses 114 of the recessed member 110. Accordingly, the rolling members 130 may retract to at least within the outer surface 124 of the slotted member 120, thus allowing the insertion of the apparatus 100 into the end of the tubular member 10.

In a subsequent step 920, insertion of the apparatus 100 into the tubular member 10 stops. Consequently, particularly if the tubular member 10 and the apparatus 100 are oriented in an upright position, such as shown in FIG. 1, the force of gravity will cause the rolling members 130 to reposition towards the shallow ends of the recesses 114 of the recessed member 110. Accordingly, the rolling members 130 may protrude from the slots 122 of the slotted member 120 and into engagement with the inner surface 10*a* of the tubular member 10. Because the slots 122 of the slotted member 120 are elongated, the rolling members 130 may independently protrude different amounts from the slots 122, such that all or most of the rolling members 130 may engage the inner surface 10*a* of the tubular member 10 despite dimensional variations of the inner surface 10*a*.

In embodiments in which the apparatus 100 includes the biasing elements 510 shown in FIGS. 5*b* and 5*c*, the biasing elements 510 may urge the rolling elements 130 towards the shallow ends of the recesses 114 once the insertion of the apparatus 100 into the tubular member 10 is halted in the step 920. Consequently, even if the tubular member 10 and the apparatus 100 are not oriented in an upright position, such as where the tubular member 10 is resting lengthwise on the ground, the rolling members 130 may still be urged to protrude from the slots 122 of the slotted member 120 and into engagement with the inner surface 10*a* of the tubular member 10.

The method 900 may include an optional step 930 during which an extraction force may be applied to the apparatus 100 in an axial direction away from the tubular member 10. Such action may facilitate axial motion of the recessed member 110 relative to the slotted member 120, thereby aiding in the repositioning of the rolling members 130 towards the shallow ends of the recesses 114 and into engagement with the inner surface 10*a* of the tubular member 10 through the slots 122 of the slotted member 120.

In a subsequent step 940, a lifting force is applied to the apparatus 100. The lifting force is or includes an axial force directed away from the tubular member 10. Consequently, the engagement of the rolling members 130 between the inner surface 10*a* of the tubular member 10 and the recesses 114 of the recessed member 110 allows the tubular member 10 to be lifted via the apparatus 100.

In view of all of the above and the exemplary embodiments depicted in FIGS. 1-9, it should be readily apparent that the present disclosure introduces a tubular handling apparatus comprising, at least in one embodiment, a slotted member having a plurality of elongated slots each extending in a direction, a recessed member slidably coupled to the slotted member and having a plurality of recesses each tapered in the direction from a shallow end to a deep end, and a plurality of rolling members each retained between one of the recesses and one of the slots, wherein each rolling member partially extends through the adjacent slot when located in the shallow end of the recess, and wherein each rolling member retracts within an outer perimeter of the slotted member when located in a deep end of the recess. The apparatus may further comprise a plurality of biasing elements each biasing a corresponding one of the rolling members towards the shallow end of the corresponding recess. Each of the plurality of biasing elements may be a compression spring, a spring plunger, and/or a ball plunger. An inner periphery of the slotted member may encompass an outer periphery of the recessed member, or an inner periphery of the recessed member may encompass an outer periphery of the slotted member. The slotted member may have a substantially cylindrical annulus cross-sectional shape and the recessed member may have a substantially cylindrical cross-sectional shape. The inner periphery of one of the recessed and slotted members may conform to the outer periphery of the other of the recessed and slotted members. The direction in which the elongated slots extend may be substantially parallel to a longitudinal axis of at least one of the slotted member and the recessed member. The plurality of rolling members may comprises a plurality of spherical members, a plurality of cylindrical members, and/or a plurality of tapered cylindrical members.

The present disclosure also introduces a method of handling a tubular member comprising, at least in one embodiment, inserting a lifting apparatus into an end of the tubular member, wherein the lifting apparatus is as described above. The plurality of rolling members are then allowed to become engaged between an internal surface of the tubular member and the plurality of recesses in the recessed member. The tubular member is then lifted via the lifting apparatus. Allowing the plurality of rolling members to become engaged may comprise allowing each of a plurality of biasing elements to urge a corresponding one of the plurality of rolling members towards the shallow end of a corresponding one of the plurality of recesses and into engagement with the internal surface of the tubular member.

The present disclosure also introduces a system comprising, at least in one embodiment, a tubular handling apparatus as described above and means for lifting the tubular handling apparatus.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A tubular handling apparatus, comprising:

a slotted member having a plurality of elongated slots each extending in a direction;

a recessed member slidably coupled to the slotted member and having a plurality of recesses each tapered in the direction from a shallow end to a deep end;

a plurality of rolling members each retained between one of the recesses and one of the slots; and a plurality of biasing elements each biasing a corresponding one of the rolling members towards the shallow end of the corresponding recess;

wherein each rolling member partially extends through the adjacent slot when located in the shallow end of the recess; and wherein each rolling member retracts to at least within the adjacent slot when located in the deep end of the recess.

2. The apparatus of claim 1 wherein each of the plurality of biasing elements is configured to urge the corresponding one of the rolling members into contact between an edge of the corresponding slot of the slotted member and the corresponding tapered recess of the recessed member.

3. The apparatus of claim 1 wherein each of the plurality of biasing elements is a compression spring.

4. The apparatus of claim 1 wherein an inner periphery of the recessed member encompasses an outer periphery of the slotted member.

5. The apparatus of claim 1 wherein at least a portion of the slotted member has a substantially cylindrical annulus-shaped cross-section and at least a portion of the recessed member has a substantially annulus shaped cross-section.

6. The apparatus of claim 1 wherein an inner periphery of one of the recessed and the slotted members conforms to an outer periphery of the other of the recessed and the slotted members.

7. The apparatus of claim 1 wherein the direction is substantially parallel to a longitudinal axis of at least one of the slotted member and the recessed member.

8. The apparatus of claim 1 wherein the plurality of rolling members comprises a plurality of spherical members.

9. The apparatus of claim 1 wherein the plurality of rolling members comprises a plurality of cylindrical members.

10. The apparatus of claim 1 wherein the plurality of rolling members comprises a plurality of tapered cylindrical members.

11. A method of handling a tubular member, comprising:

interfacing a lifting apparatus into an end of the tubular member, wherein the lifting apparatus comprises:

a slotted member having a plurality of elongated slots each extending in a direction;

a recessed member slidably coupled to the slotted member and having a plurality of recesses each tapered in the direction from a shallow end to a deep end;

a plurality of rolling members each retained between one of the recesses and one of the slots; and a plurality of biasing elements each biasing a corresponding one of the rolling members towards the shallow end of the corresponding recess;

wherein each biasing element contacts the corresponding one of the rolling members;

wherein each rolling member partially extends through the adjacent slot when located in the shallow end of the recess; and wherein each rolling member retracts to at least within the adjacent slot when located in the deep end of the recess;

allowing the plurality of rolling members to become engaged between a substantially cylindrical surface of the tubular member and the plurality of recesses in the recessed member; and lifting the tubular member via the lifting apparatus.

12. The method of claim 11 wherein allowing the plurality of rolling members to become engaged comprises allowing each of the plurality of biasing elements to urge the corresponding one of the plurality of rolling members towards the shallow end of the corresponding one of the plurality of recesses and into engagement with the surface of the tubular member.

13. The method of claim 12 wherein an inner periphery of the recessed member encompasses an outer periphery of the slotted member.

14. A system, comprising:

a tubular handling apparatus, comprising:

a slotted member having a plurality of elongated slots each extending in a direction;

a recessed member slidably coupled to the slotted member and having a plurality of recesses each tapered in the direction from a shallow end to a deep end;

a plurality of rolling members each retained between one of the recesses and one of the slots; and a plurality of biasing elements each biasing a corresponding one of the rolling members towards the shallow end of the corresponding recess;

wherein each biasing element contacts the corresponding one of the rolling members;

wherein each rolling member partially extends through the adjacent slot when located in the shallow end of the recess; and wherein each rolling member retracts to at least within the adjacent slot when located in the deep end of the recess; and means for lifting the tubular handling apparatus.

15. The system of claim 14 wherein each of the plurality of biasing elements is configured to urge the corresponding one of the rolling members into contact between an edge of the corresponding slot of the slotted member and the corresponding tapered recess of the recessed member.

16. The system of claim 14 wherein each of the plurality of biasing elements is a compression spring.

17. The system of claim 14 wherein an inner periphery of the recessed member encompasses an outer periphery of the slotted member.

18. The system of claim 14 wherein an inner periphery of one of the recessed and the slotted members conforms to an outer periphery of the other of the recessed and the slotted members.

19. A tubular handling apparatus, comprising:

a recessed member having a plurality of tapered recesses formed in an interior surface;

a slotted member positioned inside the recessed member and having a plurality of elongated slots each corresponding to one of the recesses;

a plurality of cylindrical rolling members each retained between corresponding ones of the recesses and the slots; and a plurality of compression springs each contacting a corresponding one of the rolling members and thereby urging the rolling member out of the corresponding recess towards the corresponding slot.

20. The apparatus of claim 19 wherein each of the rolling members is a tapered cylindrical member.

* * * * *

UNITED STATES PATENT AND TRADEMARK OFFICE

CERTIFICATE OF CORRECTION

PATENT NO. : 7,552,764 B2
APPLICATION NO. : 11/619946
DATED : June 30, 2009
INVENTOR(S) : Craig Weems, Stanislaw Casimir Sulima and Brian Ellis It is certified that error appears in the above-identified patent and that said Letters Patent is hereby corrected as shown below:

Column 10, between lines 43 and 44 Claim 1: Please insert the following phrase: --wherein each biasing element contacts the corresponding one of the rolling members--.

Column 10, line 61 Claim 5: Please insert a --,-- after "cylindrical."

Column 10, line 62 Claim 5: Please insert a --,-- after "cross-section."

Signed and Sealed this

First Day of September, 2009

David J. Kappos

David J. Kappos
*Director of the United States Patent and Trademark Office*